US011313304B2

(12) United States Patent
Sano et al.

(10) Patent No.: US 11,313,304 B2
(45) Date of Patent: Apr. 26, 2022

(54) HEATER ENERGIZATION CONTROL DEVICE

(71) Applicant: DENSO CORPORATION, Kariya (JP)

(72) Inventors: Ryohei Sano, Kariya (JP); Ko Tanaka, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/236,117

(22) Filed: Apr. 21, 2021

(65) Prior Publication Data

US 2021/0239061 A1 Aug. 5, 2021

Related U.S. Application Data

(63) Continuation of application No. PCT/JP2019/039138, filed on Oct. 3, 2019.

(30) Foreign Application Priority Data

Oct. 23, 2018 (JP) ..... JP2018-199583

(51) Int. Cl.
*F02D 41/14* (2006.01)

(52) U.S. Cl.
CPC ..... *F02D 41/1494* (2013.01); *F02D 41/1446* (2013.01); *F02D 41/1454* (2013.01); *F02D 2200/0414* (2013.01)

(58) Field of Classification Search
CPC ..... F02D 41/1446; F02D 41/1447; F02D 41/1494; F02D 2200/021; F02D 2200/022; F02D 2200/0414; F02D 2200/0416
USPC ..... 123/676, 678, 685, 686, 697
See application file for complete search history.

(56) References Cited

U.S. PATENT DOCUMENTS

| | | | | |
|---|---|---|---|---|
| 4,708,777 | A | 11/1987 | Kuraoka | |
| 10,337,443 | B1 * | 7/2019 | Ulrey | F02D 35/0015 |
| 2003/0070423 | A1 * | 4/2003 | Morinaga | F01N 13/0093 60/284 |
| 2004/0026408 | A1 | 2/2004 | Morinaga et al. | |
| 2007/0007134 | A1 * | 1/2007 | Kawase | G01N 27/4067 204/406 |
| 2011/0047985 | A1 * | 3/2011 | Zawacki | F02D 41/1494 60/286 |

(Continued)

FOREIGN PATENT DOCUMENTS

| | | |
|---|---|---|
| JP | 11-271264 | 10/1999 |
| JP | 2005-2974 | 1/2005 |

(Continued)

*Primary Examiner* — Erick R Solis
(74) *Attorney, Agent, or Firm* — Nixon & Vanderhye P.C.

(57) ABSTRACT

A gas sensor is provided in an exhaust passage of an engine mounted on a vehicle. The gas sensor includes a sensor element and a heater. The sensor element detects a concentration of a specific component in exhaust gas. The heater is energized with electricity from a power source to heat the sensor element. The heater energization control device controls an amount of electricity supplied to the heater. An ambient temperature acquisition unit acquires an ambient temperature, which is a temperature of an environment surrounding the engine. An energization control unit controls the amount of electricity supplied to the heater based on the ambient temperature in temperature raising energization in which a temperature of the sensor element is raised to an active temperature when the engine is started.

12 Claims, 4 Drawing Sheets

(56) References Cited

U.S. PATENT DOCUMENTS

2019/0186399 A1* 6/2019 Takada ..... F02D 45/00

FOREIGN PATENT DOCUMENTS

| | | |
|---|---|---|
| JP | 2014-25803 | 2/2014 |
| JP | 2014-55865 | 3/2014 |
| JP | 2014-238424 | 12/2014 |

* cited by examiner

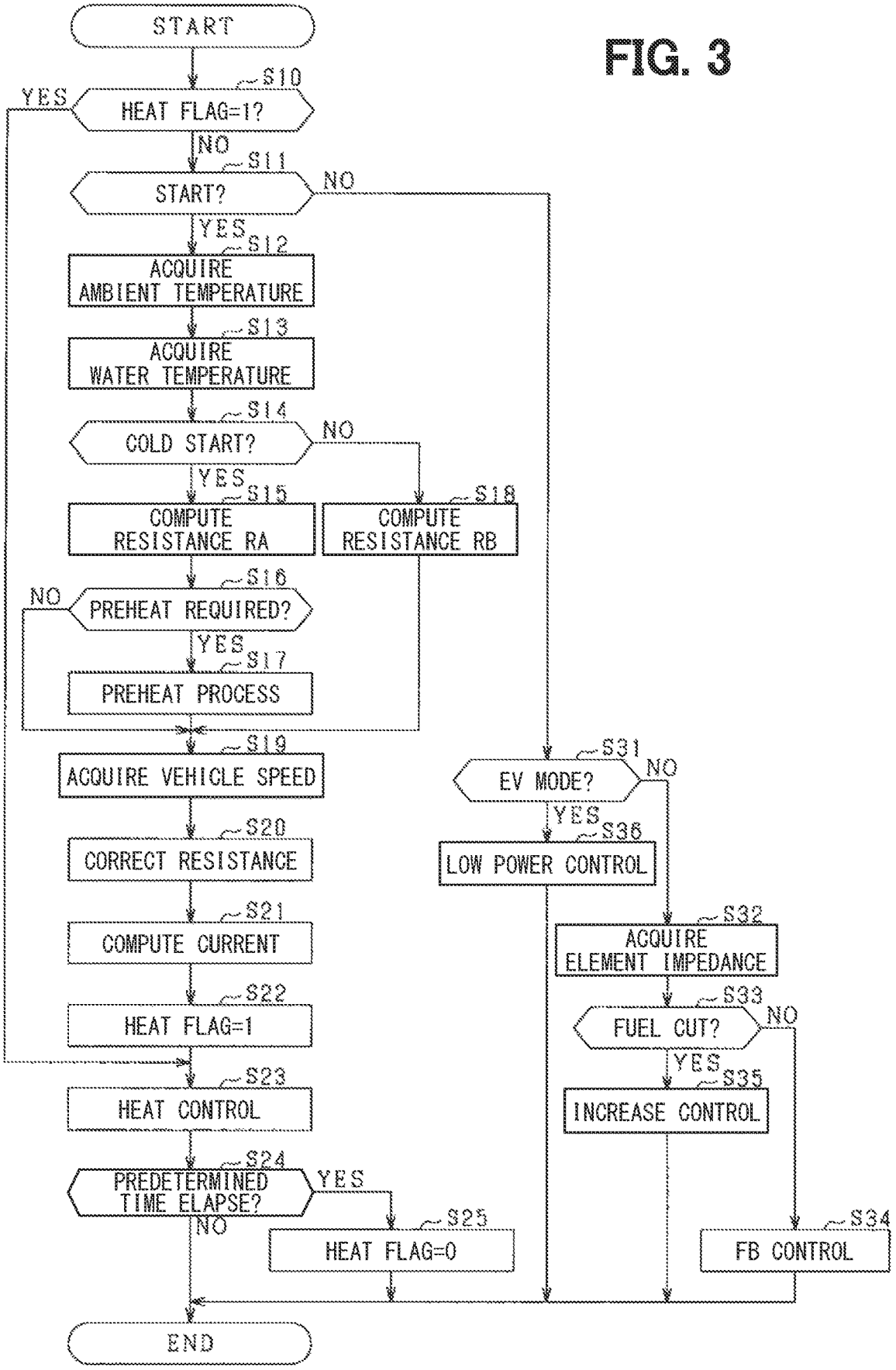
FIG. 3
START
S10
HEAT FLAG=1?
YES
NO
S11
START?
NO
YES
S12
ACQUIRE AMBIENT TEMPERATURE
S13
ACQUIRE WATER TEMPERATURE
S14
COLD START?
NO
YES
S15
COMPUTE RESISTANCE RA
S18
COMPUTE RESISTANCE RB
S16
PREHEAT REQUIRED?
NO
YES
S17
PREHEAT PROCESS
S19
ACQUIRE VEHICLE SPEED
S20
CORRECT RESISTANCE
S21
COMPUTE CURRENT
S22
HEAT FLAG=1
S23
HEAT CONTROL
S24
PREDETERMINED TIME ELAPSE?
YES
NO
S25
HEAT FLAG=0
END
S31
EV MODE?
NO
YES
S36
LOW POWER CONTROL
S32
ACQUIRE ELEMENT IMPEDANCE
S33
FUEL CUT?
NO
YES
S35
INCREASE CONTROL
S34
FB CONTROL

HEATER ENERGIZATION CONTROL DEVICE

CROSS REFERENCE TO RELATED APPLICATION

The present application is a continuation application of International Patent Application No. PCT/JP2019/039138 filed on Oct. 3, 2019, which designated the U. S. and claims the benefit of priority from Japanese Patent Application No. 2018-199583 filed on Oct. 23, 2018. The entire disclosures of all of the above applications are incorporated herein by reference.

TECHNICAL FIELD

The present disclosure relates to an energization control device for a heater of a gas sensor.

BACKGROUND

Conventionally, a gas sensor is provided in an exhaust passage of an internal combustion engine for detecting a concentration of characteristic components in exhaust gas.

SUMMARY

According to an aspect of the present disclosure, a gas sensor is provided in an exhaust passage of an engine mounted on a vehicle and includes a sensor element that detects a concentration of a specific component in exhaust gas, and a heater that is energized by power supply from a power source to heat the sensor element.

BRIEF DESCRIPTION OF THE DRAWINGS

The above and other objects, features and advantages of the present disclosure will become more apparent from the following detailed description made with reference to the accompanying drawings. In the drawings:

FIG. 3 is a flowchart showing an energization control of a heater;

DESCRIPTION OF EMBODIMENTS

Figure 1:
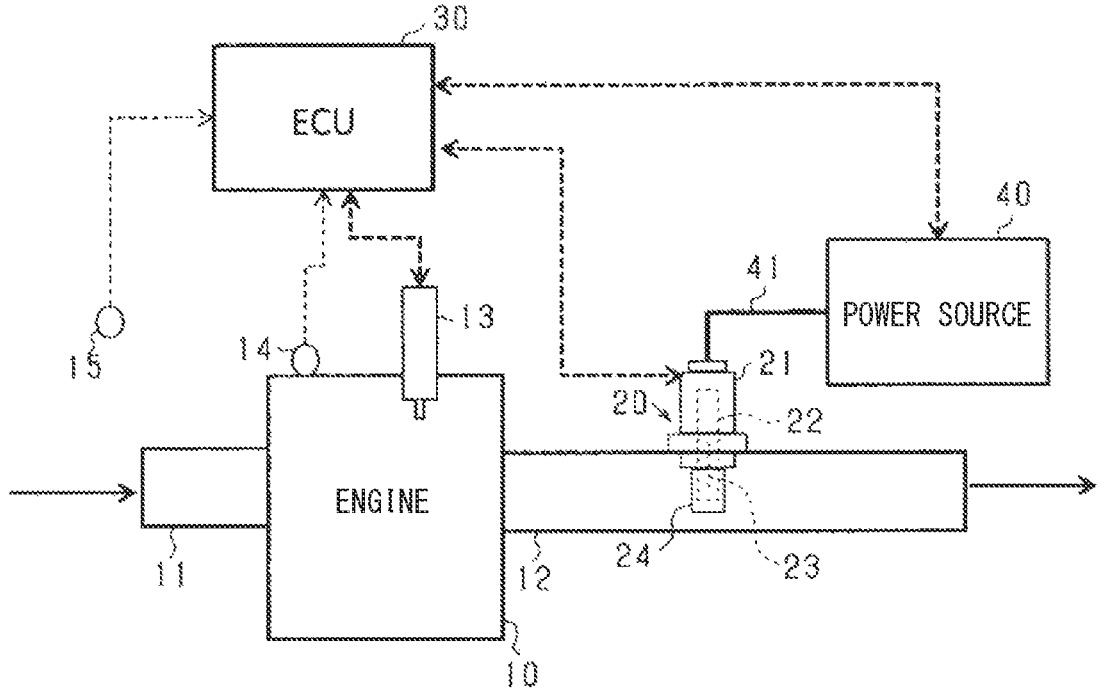
FIG. 1 is a schematic configuration diagram showing an exhaust passage of an engine.

According to an example of the present disclosure, a gas sensor is provided in an exhaust passage of an internal combustion engine for detecting a concentration of characteristic components in exhaust gas. Such a gas sensor is provided with a heater in order to raise a temperature of a sensor element to an active temperature at which the concentration can be detected.

According to an example of the present disclosure, it is conceivable to execute a preheating control that is for preventing water cracking of the gas sensor before executing a temperature rise control that is for raising the temperature of the gas sensor to an active temperature. This preheating control evaporates water adhering to the gas sensor in advance with a small amount of electricity before increasing the amount of electricity supplied to the heater to raise the temperature, thereby to enable to suppress water cracking and the like.

It is noted that, when the temperature rise control is executed, it is conceivable to increase the amount of electricity supplied to the heater at maximum to raise the temperature quickly thereby to activate the gas sensor. However, depending on the state of the surrounding environment, the amount of electricity during the temperature rise control may unintentionally become excessive to result in cracking in the element.

According to an aspect of the present disclosure, a gas sensor is installed in an exhaust passage of an engine mounted on a vehicle. The gas sensor includes a sensor element configured to detect a concentration of a specific component in exhaust gas and a heater configured to be energized by power supply from a power source to heat the sensor element. The energization control device for the heater is configured to control an amount of electricity supplied to the heater in the gas sensor.

The heater energization control device includes: an ambient temperature acquisition unit configured to acquire an ambient temperature, which is a temperature of an environment surrounding the engine; and an energization control unit configured to control the amount of electricity supplied to the heater based on the ambient temperature in temperature raising energization in which a temperature of the sensor element is raised to an active temperature when the engine is started.

When the engine is started, the heater is energized with a relatively large amount of electricity in order to activate the sensor element at an early stage. At that time, the resistance value of the energization path of the heater is a value corresponding to the temperature environment around the gas sensor. Therefore, for example, when the temperature is low, the resistance value of the heater energization path becomes small, and as a result, there is a concern that the electric power actually applied to the heater becomes excessive unintentionally.

In consideration of this, according to this aspect, the configuration controls the amount of electricity supplied to the heater based on the ambient temperature of the surrounding environment of the engine. As a result, the amount of electricity supplied to the heater can be set to the amount of electricity according to the environment, and the temperature of the sensor element can be appropriately raised.

As the gas sensor, for example, it is conceivable to use a gas sensor having a structure in which the sensor element is provided with a water-repellent coating or the like to prevent water cracking. In a case where this gas sensor is used, the preheating control time is unnecessary or shortened. Consequently, the electric power actually applied to the heater may become excessive depending on the ambient temperature. To the contrary, the above configuration sets the amount of electricity to be applied according to the environment thereby to enable to prevent the electric power input to the heater from becoming excessive.

The present embodiment is intended for, for example, an air-fuel ratio sensor which is provided in an exhaust passage of a multi-cylinder engine mounted on a hybrid vehicle and is a gas sensor for detecting a concentration of a specific component. FIG. 1 is a schematic configuration diagram showing an exhaust passage of an engine. A hybrid vehicle is configured to switch between an EV mode in which the vehicle travels with a motor as a drive source and an engine mode in which the vehicle travels with an engine as the drive source. In a hybrid vehicle, for example, the vehicle travels in the EV mode when traveling at low speed, and travels in the engine mode when traveling at medium and high speeds accompanying acceleration.

An engine 10 has a general configuration, and generates a rotational force on a crankshaft by burning fuel. Further, the engine 10 is connected to an intake passage 11 for supplying air to each combustion chamber and an exhaust passage 12 for discharging exhaust gas from each combustion chamber. Further, the engine 10 is provided with a fuel injection device 13 for injecting fuel into each combustion chamber.

Further, the engine 10 is provided with a water temperature sensor 14 that detects an engine water temperature Tw indicating a temperature of the engine 10. An outside air temperature sensor 15 is provided in an engine room where the engine 10 is arranged for acquiring an outside air temperature Ta as the ambient temperature which is a temperature of a surrounding environment of the engine 10. The device may be configured to detect, as an engine temperature, an engine oil temperature or may be configured to detect, as the engine temperature, a wall surface temperature of a cylinder block. Further, the device may be configured to use, as the outside air temperature sensor, an intake air temperature sensor that detects an intake air temperature of the engine 10. The outside air temperature sensor 15 may be provided outside the engine room.

The exhaust passage 12 is provided with an air-fuel ratio sensor 20 that detects an air-fuel ratio in the combustion chamber of the engine 10 based on an oxygen concentration in exhaust gas. The air-fuel ratio sensor 20 is, for example, a limit current type sensor, and includes a sensor element 22 held in a housing 21 and a heater 23 that heats the sensor element 22 to an active temperature. Further, the air-fuel ratio sensor 20 is provided with measures against water cracking. For example, the sensor element 22 is provided with a water-repellent coating. The sensor element 22 in the exhaust passage 12 is covered with a protective cover 24. The protective cover 24 is formed with a hole which enables exhaust gas to pass therethrough. The sensor element 22 detects the air-fuel ratio of the exhaust gas that has flowed into the protective cover 24.

Results detected by using various sensors such as the water temperature sensor 14, the outside air temperature sensor 15, and the air-fuel ratio sensor 20 are output to an ECU 30. The ECU 30 is provided with a microcomputer including a CPU, a ROM, a RAM, and the like. The ECU 30 controls an amount of air and the fuel injection device 13 according to a rotation speed and a load of the engine 10. Further, the ECU 30 controls an energization of the heater 23 of the air-fuel ratio sensor 20. The ECU 30 corresponds to an "energization control device".

Further, electric power is supplied from a power source 40 to the heater 23 of the air-fuel ratio sensor 20. The power source 40 is, for example, a lead storage battery mounted in the engine room. The power source 40 and the heater 23 are connected with a wire harness 41. Further, a PWM circuit performs the energization of the heater 23 with the power source 40. The ECU 30 controls the PWM circuit with a computed duty thereby to control an amount of electricity supplied to the heater 23. The ECU 30 sets a duty and an energization time thereby to perform a temperature raising energization control of the heater 23. The temperature raising energization control is an open control.

Next, the energization control of the heater 23 in the air-fuel ratio sensor 20 will be described. In the air-fuel ratio sensor 20, the sensor element 22 is heated to the active temperature such as 600° C. to 700° C. by using the heater 23, thereby to stimulate a mobility of oxygen ions in a solid electrolyte which constitutes the sensor element 22 to activate the sensor element 22. After the engine 10 is started, the heater is energized with a relatively large amount of electricity in order to activate the sensor element 22 promptly in order to cause the air-fuel ratio sensor 20 to be in a usable state.

Figure 2:
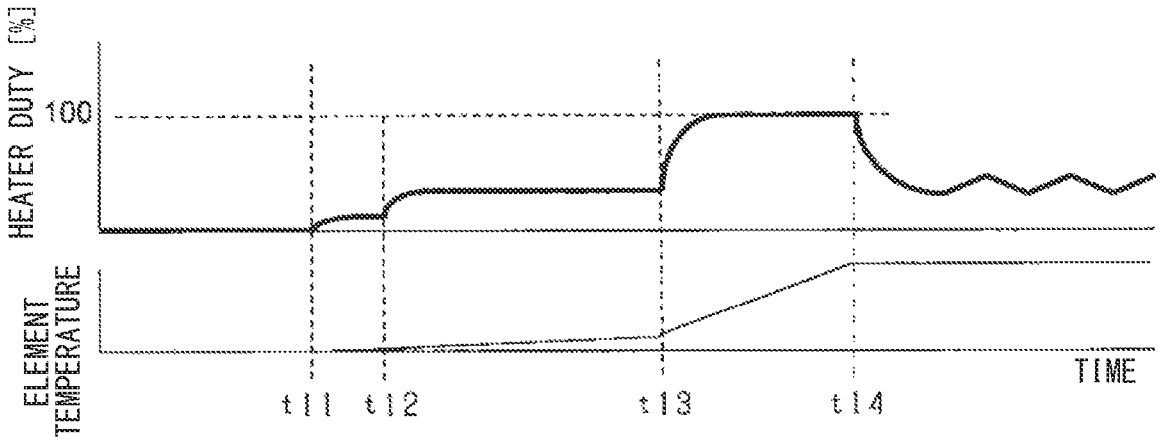
FIG. 2 is a time chart showing a temperature raising energization control in a gas sensor according to a comparative example.

As shown in FIG. 2, two types of preheat energization are carried out in a gas sensor such as an air-fuel ratio sensor according to a comparative example in order to suppress damage of the sensor element due to water cracking or the like. Specifically, this device performs preheat energization that is to prevent sudden boiling cracks due to sudden boiling of moisture adhering to the sensor element during stoppage and performs preheat energization that is to prevent water cracking due to a temperature difference caused by the moisture in the exhaust gas after starting adhering to the sensor element. FIG. 2 is a time chart showing a duty (amount of electricity) and an element temperature at the time of temperature rise energizing in this gas sensor according to a comparative example.

For example, an IG (ignition) is turned on prior to the timing t11, and preparation for combustion in the engine 10 is started. The energization of the heater 23 is started at the timing t11. At the timing t11, preheat energization is started with a very low duty (for example, about 5%) in order to suppress sudden boiling cracking. The preheat energization with a low duty is continued until a time has elapsed to suppress the sudden boiling due to moisture adhering to the sensor element.

When the time elapses to the extent that enables to suppress the sudden boiling due to moisture adhering to the sensor element, the duty increases at the timing t12. At the timing t12, in order to suppress water cracking due to moisture in exhaust gas, preheat energization is started with a duty (for example, about 10 to 20%) that is larger than that in the timing t11 to the timing t12 and that does not cause water cracking. Then, the preheat energization is continued until the temperature in the exhaust passage 12 rises due to the combustion of the engine 10 and the moisture in the exhaust is eliminated. The time for preheating and energizing to prevent water cracking is longer than the time for preheating and energizing to prevent sudden boiling cracking.

When the temperature in the exhaust passage 12 rises such that no moisture remains in the exhaust, a temperature raising energization is started at the timing t13 for raising the temperature of the sensor element to the active temperature. Specifically, by heating with the duty at 100% for a predetermined time, the element temperature is quickly raised to a target temperature in an active temperature range.

When the element temperature is raised to the target temperature at the timing t14, the heater is energized by an impedance feedback control that controls an actual impedance of the sensor element to coincide with a target impedance. Thus, electricity is supplied so that the element temperature is maintained at the target temperature.

The gas sensor (air-fuel ratio sensor 20) as in the present embodiment has a structure in which measures against water cracking are taken. This gas sensor does not require the time for preheat energization as shown in FIG. 2 or requires only the time for preheat energization as the countermeasure against sudden boiling. Therefore, the time until the start of temperature raising energization becomes very short. As a result, the temperature raising energization control of the heater 23 is started in a state where the engine 10 is not warmed up, that is, the temperature in the engine room (the temperature of the surrounding environment of the air-fuel ratio sensor 20 and the wire harness 41) is not within the predetermined range. Therefore, a resistance value of the wire harness 41, which is an energization path to the heater 23, depends on the temperature of the surrounding environment of the air-fuel ratio sensor 20.

It is considered that the temperature of the surrounding environment of the air-fuel ratio sensor 20 depends on the outside air temperature, which is the environmental temperature of the engine 10, and the engine water temperature, which is the temperature of the engine 10. For example, at the time of cold start of the engine 10, the resistance value of the wire harness 41 depends on the outside air temperature, and the lower the outside air temperature, the lower the resistance value of the wire harness 41. In such a case, in a case where the temperature raising energization control is performed at 100% duty from the beginning of energization, the electric power actually applied to the heater 23 may become excessive. In this way, the resistance value of the wire harness 41 is affected by the temperature of the surrounding environment, and even in a case where the amount of power supplied from the power source 40 is the same, the power input to the heater 23 is different. Therefore, it is necessary to set the amount of electricity supplied to the heater 23 based on the temperature of the surrounding environment.

FIG. 3 is a flowchart executed by the ECU 30 to control the energization of the heater 23, which is repeatedly executed by the ECU 30 at a predetermined cycle.

In S10, it is determined whether a heat flag is 1. The heat flag is a flag indicating that the temperature raising energization control of the heater 23 after the start of the engine 10 is in progress. The initial value of the heat flag is 0. The heat flag is set to 1 when the temperature raising energization control is performed, and is reset to 0 when the feedback control is performed after the temperature raising energization control. When the heat flag is 0 (when S10=No), the process proceeds to S11.

In S11, it is determined whether the state is at the start. The "start" indicates a state where the IG switch is turned on and the combustion of the engine 10 is started, or a state where the EV mode is changed to the engine mode and where the combustion of the engine 10 is restarted. When the state is at the start (S11=Yes), the process proceeds to S12.

In S12, the outside air temperature Ta, which is the ambient temperature of the surrounding environment of the engine 10, is acquired. Specifically, the outside air temperature Ta detected by using the outside air temperature sensor 15 is acquired. In S13, the engine water temperature Tw, which is the temperature of the engine 10, is acquired. Specifically, the engine water temperature Tw detected by using the water temperature sensor 14 is acquired. Note that S12 corresponds to an "ambient temperature acquisition unit" and S13 corresponds to an "engine temperature acquisition unit".

In S14, it is determined whether the engine 10 is in a cold start state based on the outside air temperature Ta and the engine water temperature Tw. When the engine water temperature Tw is the same as the outside air temperature Ta and is lower than a warm-up threshold value Th, it is determined that the engine 10 is in the cold start state (S14=Yes), and the process proceeds to S15. On the other hand, when the engine water temperature Tw is different from the outside air temperature Ta and the temperature is higher than the warm-up threshold value Th, it is determined that the engine 10 is in a restart state (S14=No), and the process proceeds to S16. The state where the engine water temperature Tw is the same as the outside air temperature Ta indicates that the engine water temperature is in a temperature range that may be regarded as being in the same environmental condition. Further, the warm-up threshold value Th is a threshold value for determining whether the engine 10 is in the cold start state, and is set to a value indicating whether the warm-up of the engine 10 is completed. S14 corresponds to a "determination unit".

Figure 4:
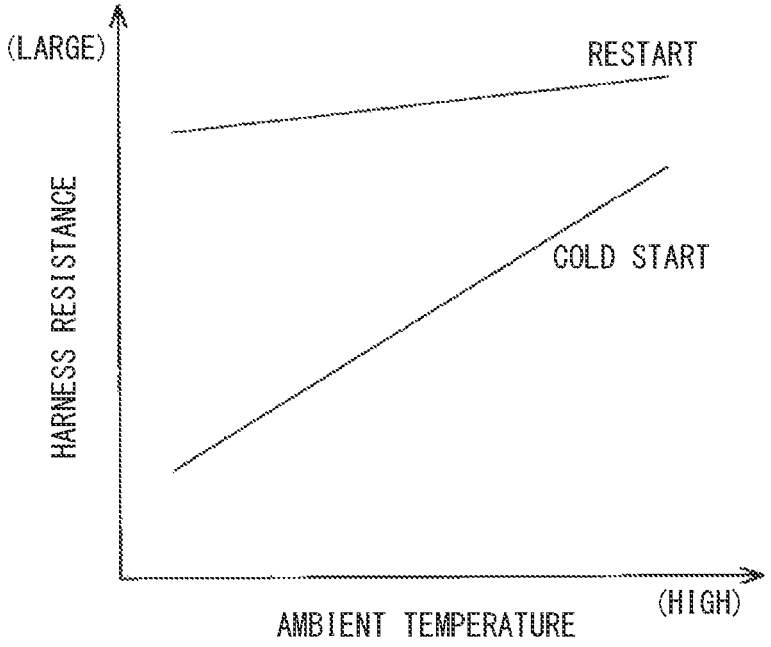
FIG. 4 is a graph showing a relationship between an outside air temperature and a resistance value of a wire harness.

When it is determined in S14 that the state is in the cold start state, in S15, a cold resistance value RA of the wire harness 41, which is the energization path in the cold start state, is computed. FIG. 4 is a graph showing a relationship between the outside air temperature and the resistance of the wire harness 41, and the cold resistance value RA of the wire harness 41 is computed based on this graph. In the cold start state, the resistance value of the wire harness 41 is intensely affected by the outside air temperature. Therefore, the amount of change in the resistance value when the outside air temperature rises is large. Then, the resistance value of the wire harness 41 is computed based on the outside air temperature Ta by using the correlation between the outside air temperature and the resistance value shown in FIG. 4.

In S16, it is determined whether the preheat energization control for preventing sudden boiling cracking is necessary. In a case where moisture is generated in the exhaust passage 12 while the engine 10 is stopped, there is a possibility that moisture adheres to the air-fuel ratio sensor 20. When it is determined that moisture is generated in the exhaust passage 12, it is determined that the preheat energization control in order to prevent sudden boiling cracking is necessary. In S17, preheat energization control is performed with a low duty (for example, about 5% to 10%) for an extremely short time for suppressing sudden boiling, and the process proceeds to S19. It should be noted that the preheat energization control may be performed without the determination in S16.

On the other hand, when it is determined in S14 that the wire harness 41 is in the restart state, the restart resistance value RB of the wire harness 41, which is the energization path in the restart state, is computed in S18. When the engine 10 is restarted from the warm-up state, the resistance value of the wire harness 41 depends not only on the outside air temperature but also on the engine water temperature. Therefore, the restart resistance value RB of the wire harness 41 is computed based on FIG. 4. In the restart state, the resistance value is also affected by the temperature of the surrounding environment other than the outside air temperature. Therefore, the amount of change in the resistance value when the outside air temperature rises is small. Further, in a case where the outside air temperature is the same, the restart resistance value RB is larger than the cold resistance value RA. Then, the resistance value of the wire harness 41 is computed based on the outside air temperature Ta by using the correlation between the outside air temperature and the resistance value shown in FIG. 4. The process proceeds to S19. Although FIG. 4 shows only one relationship for computing the restart resistance value RB, the configuration may have a map showing a plurality of correlations depending on the engine water temperature. In this case, the higher the engine water temperature, the larger the restart resistance value RB at the same temperature, and the smaller the amount of change in the resistance with respect to the outside air temperature.

In S19, vehicle speed information at the time of the start is acquired. When the vehicle is traveling at the time of the start, information on how fast the vehicle travels is acquired.

When the EV mode is shifted to the engine mode, the engine 10 is started while the vehicle travels. On the other hand, when the engine 10 is started in a stop state, the information that the vehicle speed is 0 is acquired.

Then, in S20, the cold resistance value RA or the restart resistance value RB is corrected. When the vehicle travels in the traveling state at the start, the temperature of the wire harness 41 is cooled by receiving wind due to the traveling, and therefore, the temperature of the wire harness 41 is lower than that in the stop state. As a result, the actual resistance value becomes lower than the resistance value computed based in the outside air temperature. Therefore, when the vehicle travels at the time of the start, in S20, correction is performed to reduce the computed resistance value (cold resistance value RA or restart resistance value RB) based on the information acquired in S19. That is, the resistance value of the wire harness 41 is computed based on the ambient temperature and the vehicle speed. On the other hand, when the vehicle speed is 0 according to the information acquired in S19, that is, when the vehicle is not moving at the time of the start, the resistance value computed in S15 or S18 is left as it is.

When the processing of S20 is completed, in S21, the amount of electricity at the time of the temperature raising energization is computed. The temperature raising energization control is an open control to control energization for a pre-computed energization time with a pre-computed duty. In S21, the amount of electricity is computed based on the resistance value of the wire harness 41 computed in S20. Specifically, the amount of electricity supplied from the power source 40 is computed from the resistance value by using a map or the like computed in advance. At this time, the smaller the resistance value, the larger the amount of current flowing through the wire harness 41. Therefore, when the resistance value is small, the duty is lowered to 90 to 95% instead of 100%, or the energization time is shortened so that the amount of electricity is set according to the resistance value.

When the amount of electricity is computed in S21, the heat flag is set to 1 in S22. When the heat flag becomes 1 in S22, or when it is determined in S10 that the heat flag is 1 (S10=Yes), the temperature raising energization control is performed in S23. Specifically, the electric power is supplied from the power source 40 with the duty computed in S21.

Then, in S24, it is determined whether a predetermined time has elapsed since the heat flag has become 1, that is, whether the temperature raising energization has been performed during the energization time computed in S21. When the predetermined time has not elapsed (S24=No), the process ends. When the predetermined time has elapsed, the process proceeds to S25. In S25, the heat flag is reset to 0, and a process is executed to end the temperature raising energization. Then, the device sets to perform the feedback control based on the element impedance. Note that S15, S18, S20, S21, S23, and S24 correspond to a "energization control unit".

When it is determined in S11 that it is not at the time of the start (S11=No), the process proceeds to S31. In S31, it is determined whether the state is in the EV mode, that is, whether the operation of the engine 10 is stopped. Note that S31 corresponds to a "rest determination unit".

When it is determined in S31 that the state is not the EV mode (S31=No), the process proceeds to S32. In S32, the element impedance of the sensor element 22 is acquired. The element impedance is a value having a correlation with the temperature of the sensor element 22. Note that S32 corresponds to a "sensor temperature acquisition unit".

Then, in S33, it is determined whether fuel is being cut (during fuel cut). When it is determined in S33 that the fuel is not being cut (S33=No), the process proceeds to S34. In S34, the feedback control is performed in which the amount of electricity supplied to the heater 23 within a predetermined range is computed in order to cause the acquired element impedance to coincide with the target impedance. The feedback control is performed to enable the temperature of the sensor element 22 to be maintained at the target temperature at which the sensor element 22 can be activated.

When it is determined in S33 that the fuel is being cut (S33=No), in S35, an increase control is performed for increasing the amount of electricity supplied to the heater 23. During the fuel cut, the fuel injection of the engine 10 is stopped and the combustion is stopped. Then, during the fuel cut, the air supplied into the engine 10 from the intake passage 11 is discharged to the exhaust passage 12. In the state where the combustion is not in the engine 10, the air-fuel ratio sensor 20 does not need to monitor the exhaust gas. On the other hand, the fuel cut state ends in a relatively short time, and therefore, it is necessary to energize the heater 23 to maintain the active state of the air-fuel ratio sensor 20. However, during the fuel cut, the relatively cold air supplied from the intake passage 11 flows through the exhaust passage 12, and therefore, the air-fuel ratio sensor 20 energized with a normal amount of electricity is cooled.

Therefore, in S35, the increase control is performed for increasing the amount of electricity supplied to the heater 23. In the increase control, the amount of electricity supplied to the heater 23 is allowed to be larger than the predetermined range of the feedback control. Specifically, an upper limit value of the duty set at the time of a normal feedback control is removed thereby to enable to increase the duty of the feedback control. Then, the amount of electricity supplied to the heater 23 is set to be larger than the predetermined range of the feedback control. As a method of the increase control, a feedback gain at the time of the fuel cut may be increased more than a feedback gain at the normal time when the fuel is not cut. As a result, the duty at the time of the fuel cut can be made larger than the duty at the normal time, and the amount of electricity supplied to the heater 23 can be increased. Note that S34 and S35 correspond to a "feedback control unit".

On the other hand, when it is determined that the state is in the EV mode (S31=Yes), a low power control is performed in S36 so that the amount of electricity supplied to the heater 23 is a predetermined low power. During the EV mode (while running on the motor), the engine 10 is inactive and exhaust gas from the engine 10 does not occur. Therefore, the air-fuel ratio sensor 20 does not need to monitor the exhaust gas and does not need to maintain the active state of the sensor element 22. Further, it is unpredictable when the EV mode will end, and therefore, it is preferable to suppress power consumption during the EV mode. Therefore, during the EV mode, the low-power energization is performed in which the heater 23 is continuously energized to the extent that adhesion of water to the air-fuel ratio sensor 20 is suppressed (for example, the duty is about 5% to 10%). This eliminates the need for preheating energization to suppress sudden boiling when restarting from the EV mode. In the case of the low power energization, the energization of the heater 23 may be set to 0, and preheating energization may be performed at predetermined intervals to suppress the adhesion of water. Further, the energization of the heater 23 may be set to 0 during the EV mode. In a case where the energization of the heater 23 is continuously set to 0, it is determined whether or not the preheating energization is necessary even when restarting from the EV mode, and the preheating energization control is performed if necessary.

Figure 5:
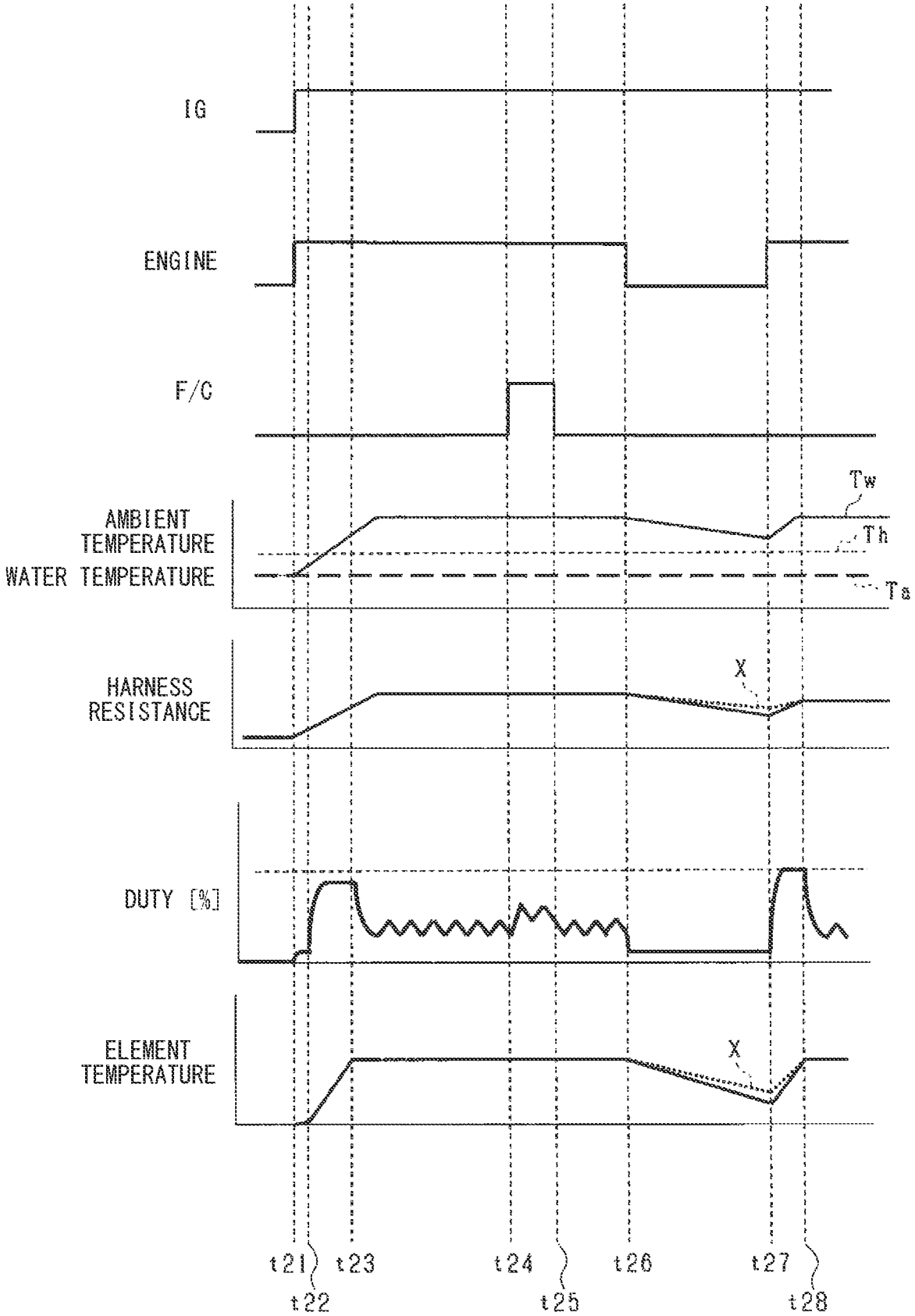
FIG. 5 is a time chart showing an energization state of the heater.

FIG. 5 is a time chart when the energization control of the heater 23 is performed by the process of FIG. 3. Next, and this time chart will be described. The IG indicates whether the ignition is on (the vehicle is moving). The ENGINE indicates whether the engine 10 is in operation (on state) or inactive (off state). The F/C indicates whether the fuel is being cut (on state). Further, the ambient temperature Ta and the engine water temperature Tw indicate the values detected by using the outside air temperature sensor 15 and the water temperature sensor 14. The broken line is the value indicating the outside air temperature Ta, and the solid line is the engine water temperature Tw. The HARNESS RESISTANCE indicates the resistance value of the wire harness 41 computed from the surrounding environment. The DUTY indicates the duty of energizing the heater 23. The ELEMENT TEMPERATURE indicates the temperature of the sensor element 22 computed from the impedance of the sensor element 22.

When the IG is turned on at the timing t21, the operation of the engine 10 is started. Then, at the timing t21, the outside air temperature Ta and the engine water temperature Tw are the same and smaller than the warm-up threshold value Th. Therefore, it is determined that the state is in the cold start state. Then, the cold resistance value RA of the cold wire harness 41 is computed from the map that is based on the outside air temperature Ta. Then, the amount of electricity is computed based on the cold resistance value RA of the wire harness 41. Further, the temperature at the time of starting is low. Therefore, there is a risk of sudden boiling. Thus, the preheating energization control in which the duty of the heater 23 is lowered is performed.

At the timing t22, the preheating energization control ends, and the temperature raising energization control starts. At this time, energization is performed for a predetermined time with a duty lower than 100% based on the amount of electricity computed at the timing t21. That is, in the cold start state, as a first energization control, the temperature raising energization control based on the cold resistance value RA is performed. In this way, the configuration enables to prevent the heater 23 from becoming excessively energized and to appropriately heat the sensor element 22.

When the predetermined time elapses, the temperature raising energization control ends at the timing t23, and the temperature of the sensor element 22 is raised to the target temperature. Then, the impedance feedback control is performed for maintaining the temperature of the sensor element 22 at the target temperature. When the engine water temperature Tw reaches a certain value, the ambient temperature around the air-fuel ratio sensor 20 becomes also constant. Therefore, the computed harness resistance value is also constant.

At the timing t24, the fuel injection by using the fuel injection device 13 is stopped, and fuel is cut. Then, the amount of electricity supplied to the heater 23 during feedback control is allowed to become larger than the predetermined range, and the duty is increased as compared with the normal feedback control. In this way, the sensor element 22 exposed to the atmosphere during the fuel cut can be kept in the active state. Then, when the fuel cut is completed at the timing t25, the feedback control returns to the control in the normal predetermined range.

When the EV mode is set at the timing t26, and the operation of the engine 10 is put into the rest state, the heater 23 is continuously energized with the predetermined low power energization. This configuration continues the energization of the heater 23 with the low electric power, thereby to enable to suppress the amount of electricity while suppressing adhesion of water to the sensor element 22.

When the engine 10 is started by shifting from the EV mode to the engine mode at the timing t27, the temperature of the sensor element 22 is low, and therefore, the temperature raising energization control is performed again. In this state, the outside air temperature Ta and the engine water temperature Tw are not the same, and the engine water temperature Tw exceeds the warm-up threshold Th. Therefore, it is determined that the state is in the restart state. Then, the restart resistance value RB of the wire harness 41 is computed from the map that is based on the outside air temperature Ta and the engine water temperature Tw. The vehicle is traveling in the EV mode, and therefore, the resistance value of the wire harness 41 is corrected and reduced based on the vehicle speed. Then, the amount of electricity is computed based on the resistance value of the wire harness 41, and the temperature raising energization control is started. The resistance value of the wire harness 41 is larger than that in the cold start state, and therefore, the temperature is raised with the duty of 100%. That is, in the warm-up start state, the temperature raising energization control is performed as the second energization control based on the restart resistance value RB. In this way, when there is no possibility that the energization amount of the heater 23 becomes excessive, this configuration raises the temperature with 100% duty, thereby to enable to raise the temperature quickly.

When the predetermined time, which has been set, elapses, the temperature raising energization control ends at the timing t28, and the temperature of the sensor element 22 is raised to the target temperature. Then, the impedance feedback control is performed for maintaining the temperature of the sensor element 22 at the target temperature.

The above-described embodiment produces the following effects.

When the engine 10 is started, the heater 23 is energized with a relatively large amount of electricity in order to activate the sensor element 22 at an early stage. At that time, the resistance value of the energization path (wire harness 41) of the heater 23 is a value corresponding to the ambient temperature around the air-fuel ratio sensor 20. Therefore, for example, when the temperature is low, the resistance value of the wire harness 41 becomes small, and as a result, there is a concern that the electric power actually applied to the heater 23 becomes excessive unintentionally.

Therefore, in the present embodiment, the amount of electricity supplied to the heater 23 is controlled based on the ambient temperature of the surrounding environment of the engine 10. As a result, the amount of electricity supplied to the heater 23 can be set to the amount of electricity according to the environment, and the temperature of the sensor element 22 can be appropriately raised.

As in the present embodiment, in the configuration in which the air-fuel ratio sensor 20 having the structure in which the sensor element 22 is provided with the water-repellent coating or the like to prevent water cracking is used as the gas sensor, the time for the preheating control is unnecessary or shortened. Therefore, the electric power actually applied to the heater may become excessive depending on the ambient temperature. The above configuration sets the amount of electricity to be supplied according to the environment thereby to enable to prevent the electric power input to the heater 23 from becoming excessive.

It is conceivable that the temperature of the surrounding environment of the air-fuel ratio sensor 20 depends not only on the outside air temperature, which is the environmental temperature of the engine 10, but also on the engine temperature (engine water temperature), which is the temperature of the engine 10. For example, at the time of the cold start of the engine 10, the resistance value of the energization path (wire harness 41) of the heater 23 depends on the ambient temperature, and as the ambient temperature becomes lower, the resistance of the energization path of the heater 23 becomes lower. On the other hand, when the engine 10 is restarted from the warm-up state, the resistance value of the energization path of the heater 23 depends not only on the outside air temperature but also on the engine temperature.

Therefore, in the present embodiment, the energization control of the heater 23 is differed between the cold start state and the restart state. In this way, the energization control can be performed according to the environment, and the temperature of the sensor element 22 can be appropriately raised.

The resistance value of the wire harness 41 connecting the power source 40 with the heater 23 differs depending on the surrounding environmental conditions. As the resistance value differs, the electric power actually supplied to the heater 23 of the air-fuel ratio sensor 20 differs. In the cold start state, the influence of the outside air temperature is large. Therefore, the resistance value is computed based on the outside air temperature, and the first energization control is performed based on the resistance value. In the restart state, the engine warm-up state is grasped from the engine water temperature, and the resistance value is computed based on the ambient temperature and the engine temperature. Thus, the second energization control is performed based on the resistance value. The resistance value is computed in this way, and the control is performed based on the resistance value. Thus, the temperature of the sensor element 22 can be appropriately raised.

The wire harness 41 and the like are exposed to the wind while the vehicle is running. Therefore, the temperature of the wire harness 41 is likely lower than the environmental temperature of the wire harness 41 estimated from the outside air temperature and the engine temperature, and the resistance value of the wire harness 41 likely becomes lower. Therefore, the resistance value computed based on the outside air temperature and the engine temperature is further computed to become lower according to the vehicle speed. Thus, a computation error can be further suppressed, and an appropriate energization amount can be acquired.

During the fuel cut of the engine 10, combustion is not performed in the engine 10, and the intake air passes through as it is. Therefore, the temperature of the exhaust gas decreases. In this case, the air-fuel ratio sensor 20 is exposed to the exhaust gas, and therefore, the temperature of the air-fuel ratio sensor 20 drops and then rises again in normal feedback control. Consequently, when combustion starts again, the temperature may be in the state where being dropped. Therefore, during the fuel cut, the duty (feedback gain) is increased as compared with the normal feedback control to prevent the temperature of the air-fuel ratio sensor 20 from dropping.

There is a possibility that the air-fuel ratio sensor 20 may not be used for a long time while the operation of the engine 10 is suspended, for example, when the hybrid vehicle is driven with the motor (in the EV mode). In such a case, the electric power used for maintaining the temperature of the air-fuel ratio sensor 20 is suppressed by reducing the amount of electricity supplied to the heater 23 and maintaining the energization at the low power energization. In this way, this configuration enables to suppress the electric power used to maintain the temperature of the air-fuel ratio sensor 20.

(Other Embodiments)

The present disclosure is not limited to the embodiments described above, and may be implemented as follows, for example.

In the above embodiment, the hybrid vehicle is the subject. It is noted that, a vehicle with an idling stop function may be the subject. In this case, in S31 of the process in FIG. 3, as the determination of whether the engine 10 is in rest, it is determined whether the engine 10 is in the idling stop. In the case of the idling stop, the amount of electricity is controlled and reduced in S36.

The idling stop is generally performed when the vehicle is stopped or the like. Therefore, the resistance value of the wire harness 41 at the time of the restart is hardly affected by the vehicle speed. In the time chart of FIG. 5, the vehicle is not travelling while the engine 10 is stopped. Therefore, as shown by the broken line X, the element temperature is less likely to drop than in the EV mode. Further, the resistance value of the wire harness 41 depends on the outside air temperature and the engine water temperature, and no correction due to the traveling is made. Therefore, as shown by the broken line X, the resistance value of the wire harness 41 becomes larger than that in the EV mode. As a result, the amount of electricity (energization time) at the time of the temperature raising energization becomes slightly longer than that in the EV mode. In this way, the correction is appropriately performed according to the vehicle speed and the like, and the temperature raising energization control can be performed more appropriately.

The gas sensor may not be the air-fuel ratio sensor, but may be another gas sensor that is raised in temperature by the heater 23. For example, the energization control as in the present embodiment may be used for a mixed potential type NOx sensor or the like.

In the above embodiment, the resistance value of the wire harness 41 is computed, and the amount of electricity is computed based on the resistance value. It is noted that, the duty and the energization time may be computed from a map or the like based on the outside air temperature and the engine water temperature without computing the resistance value of the wire harness 41.

In the above embodiment, as the second energization control at the time of the restart, the restart resistance value RB of the wire harness 41 is computed based on the outside air temperature and the engine water temperature, and the control is performed based on the restart resistance value RB. It is noted that, as the second energization control at the time of the restart, the amount of electricity for the temperature raising energization control may be computed based on another factor other than the ambient temperature, for example, the element temperature.

The controller (control unit) and the method described in the present disclosure may be implemented by a special purpose computer which is configured with a memory and a processor programmed to execute one or more particular functions embodied in computer programs of the memory. Alternatively, the controller and the method described in the present disclosure may be implemented by a special purpose computer configured as a processor with one or more special purpose hardware logic circuits. Alternatively, the controller and the method described in the present disclosure may be implemented by one or more special purpose computer, which is configured as a combination of a processor and a memory, which are programmed to perform one or more functions, and a processor which is configured with one or more hardware logic circuits. The computer programs may be stored, as instructions to be executed by a computer, in a tangible non-transitory computer-readable medium.

Although the present disclosure has been described in accordance with the examples, it is understood that the present disclosure is not limited to such examples or structures. The present disclosure encompasses various modifications and variations within the scope of equivalents. In addition, while the various combinations and configurations, which are preferred, other combinations and configurations, including more, less or only a single element, are also within the spirit and scope of the present disclosure.

What is claimed is:

1. A heater energization control device for a gas sensor provided in an exhaust passage of an engine mounted on a vehicle, the gas sensor including a sensor element configured to detect a concentration of a specific component in exhaust gas and a heater configured to be energized with electricity from a power source to heat the sensor element, the heater energization control device configured to control an amount of electricity supplied to the heater, the heater energization control device comprising:

an ambient temperature acquisition unit configured to acquire an ambient temperature, which is a temperature of an environment surrounding the engine; and an energization control unit configured to control the amount of electricity supplied to the heater based on the ambient temperature in temperature raising energization in which a temperature of the sensor element is raised to an active temperature when the engine is started, wherein the energization control unit configured to, when the ambient temperature is lower than a predetermined temperature, supply electricity to the heater with a duty, which is lower than a duty when the ambient temperature is the predetermined temperature, regardless of a temperature of the heater.

2. The heater energization control device according to claim 1, further comprising:

an engine temperature acquisition unit configured to acquire an engine temperature, which is a temperature of the engine; and a determination unit configured to determine that the engine is in a cold start state based on the engine temperature that is lower than a warm-up threshold that is the same as the ambient temperature and indicates that the engine is warmed up and determine that the engine is in a restart state based on the engine temperature that is different from the ambient temperature and is higher than the warm-up threshold, wherein the energization control unit is configured to perform, as heater energization, a first energization control when the determination unit determines that the engine is in the cold start state and a second energization control that is different from the first energization control when the determination unit determines that the engine is in the restart state.

3. The heater energization control device according to claim 2, wherein the energization control unit is configured to compute a resistance value of a heater energization path that connects the power source with the heater based on the ambient temperature in the cold start state and perform the first energization control based on the resistance value and compute the resistance value of the heater energization path based on the ambient temperature and the engine temperature in the restart state and perform the second energization control based on the resistance value.

4. The heater energization control device according to claim 1, wherein the vehicle is configured to start the engine while the vehicle travels, and the energization control unit is configured to control the amount of electricity supplied to the heater based on the ambient temperature and a speed of the vehicle when the engine is started while the vehicle travels.

5. The heater energization control device according to claim 1, further comprising:

a sensor temperature acquisition unit configured to acquire a temperature of the sensor element or a value correlated with the temperature of the sensor element; and a feedback control unit configured to feedback-control the amount of electricity supplied to the heater in a predetermined range to control the temperature of the sensor element at a target value, after the energization control unit performs the temperature raising energization, wherein the feedback control unit is configured to increase a feedback gain when fuel cut is performed on the engine or allow the amount of electricity supplied to the heater to be larger than the predetermined range.

6. The heater energization control device according to claim 1, further comprising:

a rest determination unit configured to determine whether the engine is in a rest state, wherein the feedback control unit is configured to continue energization of the heater with a predetermined low power energization to suppress adhesion of water to the sensor element, when the engine is in the rest state.

7. A heater energization control device comprising:

a processor configured to acquire an ambient temperature, which is a temperature of an environment surrounding an engine of a vehicle, control an amount of electricity supplied to a heater to heat a sensor element of a gas sensor, which is provided in an exhaust passage of the engine and configured to detect a concentration of a specific component in exhaust gas of the engine, based on the ambient temperature in a state where a temperature of the sensor element is raised to an active temperature and where the engine is started, when the ambient temperature is lower than a predetermined temperature, supply electricity to the heater with a duty, which is lower than a duty when the ambient temperature is the predetermined temperature, regardless of a temperature of the heater.

8. The heater energization control device according to claim 1, wherein the duty, which is lower than the duty when the ambient temperature is the predetermined temperature, is greater than 0.

9. The heater energization control device according to claim 7, wherein the duty, which is lower than the duty when the ambient temperature is the predetermined temperature, is greater than 0.

10. The heater energization control device according to claim 1, wherein the energization control unit is configured to supply electricity to the heater with a constant duty, which is constant, immediately after the engine is started until a temperature of the sensor element is raised to a predetermined target temperature, the constant duty is set to be smaller than the duty, which is used when the ambient temperature is the predetermined temperature, when the ambient temperature is lower than the predetermined temperature immediately after the engine is started.

11. The heater energization control device according to claim 7, wherein the processor is configured to:

supply electricity to the heater with a constant duty, which is constant, and immediately after the engine is started until a temperature of the sensor element is raised to a predetermined target temperature, set the constant duty to be smaller than the duty, which is used when the ambient temperature is the predetermined temperature, when the ambient temperature is lower than the predetermined temperature immediately after the engine is started.

12. A heater energization control device for a gas sensor provided in an exhaust passage of an engine mounted on a vehicle, the gas sensor including a sensor element configured to detect a concentration of a specific component in exhaust gas and a heater configured to be energized with electricity from a power source to heat the sensor element, the heater energization control device configured to control an amount of electricity supplied to the heater, the heater energization control device comprising:

an ambient temperature acquisition unit configured to acquire an ambient temperature, which is a temperature of an environment surrounding the engine; and an energization control unit configured to control the amount of electricity supplied to the heater based on the ambient temperature in temperature raising energization in which a temperature of the sensor element is raised to an active temperature when the engine is started, a sensor temperature acquisition unit configured to acquire a temperature of the sensor element or a value correlated with the temperature of the sensor element; and a feedback control unit configured to feedback-control the amount of electricity supplied to the heater in a predetermined range to control the temperature of the sensor element at a target value, after the energization control unit performs the temperature raising energization, wherein the feedback control unit is configured to:

increase a feedback gain when fuel cut is performed on the engine or allow the amount of electricity supplied to the heater to be larger than the predetermined range.

* * * * *